US007047650B2

(12) United States Patent
Chen

(10) Patent No.: US 7,047,650 B2
(45) Date of Patent: May 23, 2006

(54) HAND-OPERATED CIRCULAR SAW HAVING BLADE CUTTING DEPTH ADJUSTMENT DEVICE

(76) Inventor: Yuehting Chen, P.O. Box 697, Feng-Yuan City, Taichung Hsien (TW) 420

( * ) Notice: Subject to any disclaimer, the term of this patent is extended or adjusted under 35 U.S.C. 154(b) by 57 days.

(21) Appl. No.: 10/791,724

(22) Filed: Mar. 4, 2004

(65) Prior Publication Data

US 2005/0155233 A1 Jul. 21, 2005

(30) Foreign Application Priority Data

Jan. 20, 2004 (TW) ..... 93201126 U

(51) Int. Cl.
*B27B 9/02* (2006.01)

(52) U.S. Cl. ..... 30/388; 30/373; 30/390

(58) Field of Classification Search ..... 30/370, 30/371, 373, 377, 390, 388, 391; 451/358, 451/359, 451, 452, 455; 144/251.1

See application file for complete search history.

(56) References Cited

U.S. PATENT DOCUMENTS

| | | | | |
|---|---|---|---|---|
| 5,005,321 | A * | 4/1991 | Barth et al. | 451/359 |
| 5,031,325 | A * | 7/1991 | Walter et al. | 30/390 |
| 5,637,035 | A * | 6/1997 | Yee | 451/358 |
| 5,784,789 | A * | 7/1998 | Vargas | 30/388 |
| 5,974,674 | A * | 11/1999 | Kelly | 30/391 |
| 6,699,114 | B1 * | 3/2004 | Booeshaghi et al. | 451/451 |

* cited by examiner

*Primary Examiner*—Hwei-Siu Payer

(57) ABSTRACT

A hand-operated circular saw having blade cutting depth the adjustment device includes a hollow interior tubular body having a hand grasp portion, a head portion, a motor disposed in the head portion to operate a threaded axis protrude from a threaded circular protrusion on an outer side of head portion, an upper plate secured to the outer side including a circular hole engaged with the circular protrusions, a pair of pivotal tubes and a pair of horizontal arc protrusions on the top, a guard plate, a pad ring, an internally thread tube and a saw blade sequentially secured to the axis, a lower plate connected to a pair of cylinder rods inside the pivotal tubes, a pair of quickly operated bolts in the top of the pivotal tubes for adjusting the vertical positions of the lower plate and the saw blade, and a cutting depth adjustment device.

3 Claims, 11 Drawing Sheets

HAND-OPERATED CIRCULAR SAW HAVING BLADE CUTTING DEPTH ADJUSTMENT DEVICE

BACKGROUND OF THE INVENTION

The present invention relates to carpentry and brick layer's cutting tools and more particularly to a hand-operated circular saw having blade cutting depth adjustment device which is capable of leaning on a wall, a top of table and/or the ground to precisely cut a work object.

As we know that the conventional cutting machine is principally of the table type having a rotatable saw blade on the top for cutting lumbers, tiles and/or stones, on which the work piece are usually pushed to the saw blade. Because the work piece may be too large or too small to fit the saw blade, it is difficult to cut on the table type cutting machine. Thus a hand-operated circular saw appears in the market. This type of circular saw can be freely operated by the user because it is graspable by the hand of the user. However, its rapidly rotated saw blade may unintentionally hurt people or the user himself if he works unconsciously.

FIG. 1 shows a prior art hand-operated circular saw which comprises a graspable main body 10, a head 11, a threaded axis operated by a motor inside the head 11, a saw blade 13 wrapped onto the axis 12 and secured by a nut 14 and a guard 15 protected a great portion of the saw blade 13. This type of the hand-operated circular saw has a disadvantage that the guard 15 could not lean on object to cut a work piece.

FIGS. 2 and 3 show another prior art hand-operated circular saw 20 which comprises a graspable main body 21, a head 22, a threaded axis 23 operated by a motor inside the head 22, a guard 26 secured to the head 22 by a plurality of screws, an inner cover 261 wrapped on the guard 26 before a saw blade 24 secured onto the axis 23, an outer cover 262 wrapped to the outside of the inner cover 261 with an arcuate spring 28 disposed therebetween for providing the rotatable resilient force to the outer cover 262, an outer guard 27 disposed on the top of the guard 26 having a plurality of slots 271 in the peripheral wall for adjustably securing the outer guard 27 to the guard 26 by a plurality of bolts, an internally threaded block 272, a butterfly nuts 273 and a U-shaped handle 29 pivoted to the head 22 by screws 274. In operation, the outer guard 27 can be adjusted to lean on a wall in accordance with the cutting depth of a work piece and the covers 261 and 262 are immediately returned to their original positions right after the saw blade 24 removed from the work piece in order to prevent the dirt and the water from sprayed to the user. The adjustment of the outer guard 27 needs experience and must be tried again and again, and that's inconvenient.

SUMMARY OF THE PRESENT INVENTION

The present invention has a main object to provide a hand-operated circular saw having blade cutting depth adjustment device in which a lower plate and a lateral plate are adjustable to decide the cutting depth of the blade and to enable the circular saw to lean on a plane surface of a table and/or a wall during operation.

Accordingly, the hand-operated circular saw of the present invention comprises a main body having a hand grasp portion and a head portion, a motor inside the head portion to operate a thread axis on a lateral side thereof, an upper cover secured to a lateral side of the head portion, a lower plate with a guard disposed therebetween for protecting therein a circular saw blade which is secured on the threaded axis. The upper cover has at least a pair of symmetrical pivot tubes each of which has a spring, an internally thread cylinder rod connected with the lower plate by screws and a quickly operated bolt inserted into the top thereof screwed within the upper portion of the cylinder rods to adjust the vertical movement of the cylinder rods. A lateral plate disposed on the front of the head portion connected at least an internally threaded elongate cylinder rod which has its front portion slidably inserted into a positioning through hole on an upper surface of the upper plate. Therefore, the lower plate is vertically adjustable to enable the hand-operated circular saw to lean on the plane surface of a table, a wall and/or a ground and the lateral plate is horizontally adjustable to decide the cutting depth of the saw blade. This adjustment is very easy, convenient and precise.

The present invention will become more fully understood by reference to the following detailed description thereof when read in conjunction with the attached drawings.

DETAILED DESCRIPTION OF THE PREFERRED EMBODIMENT

Figure 1:
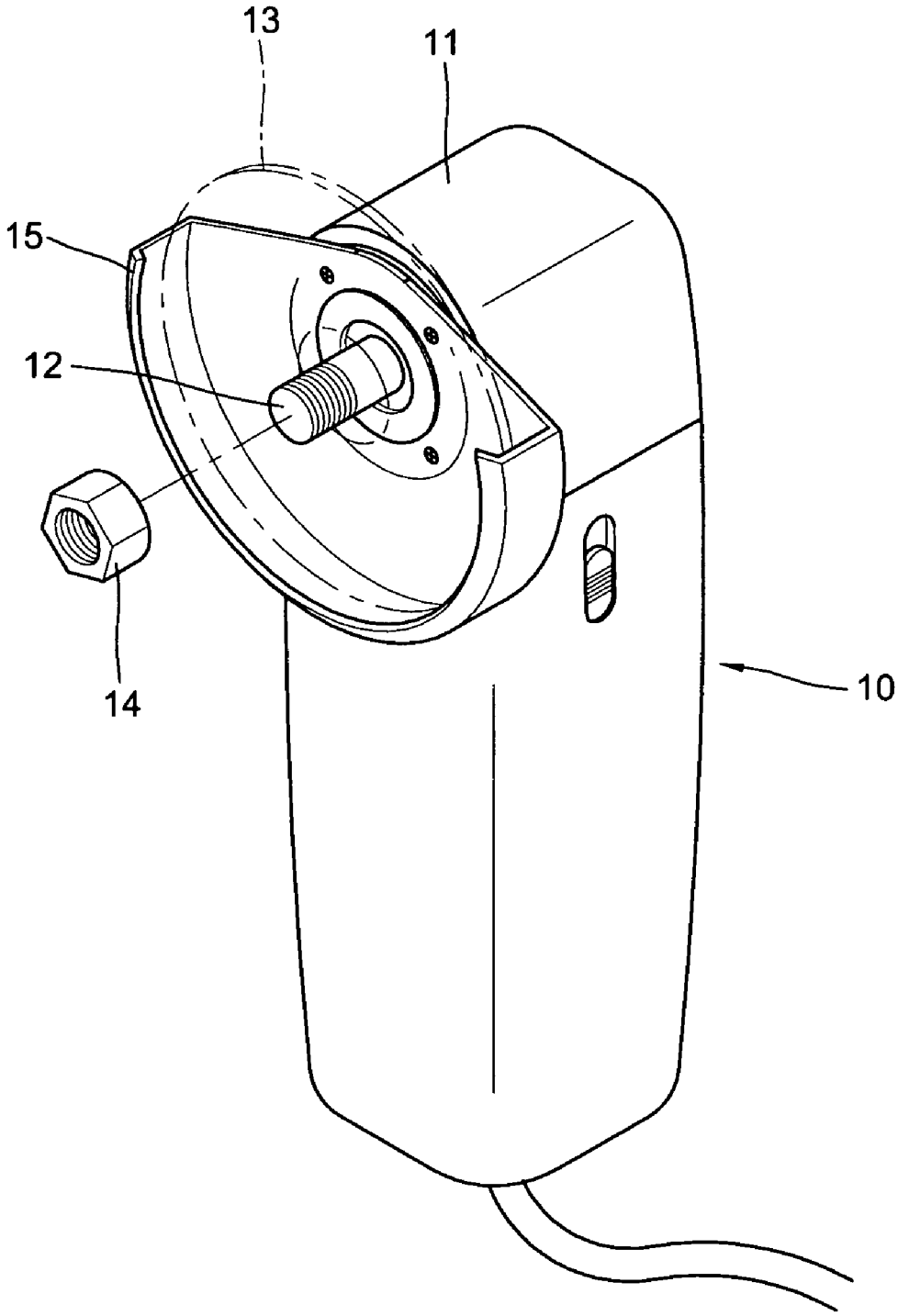
FIG.1 Prior Art
FIG. 1 is a perspective view of a hand-operated circular saw according to a prior art.
Figure 2:
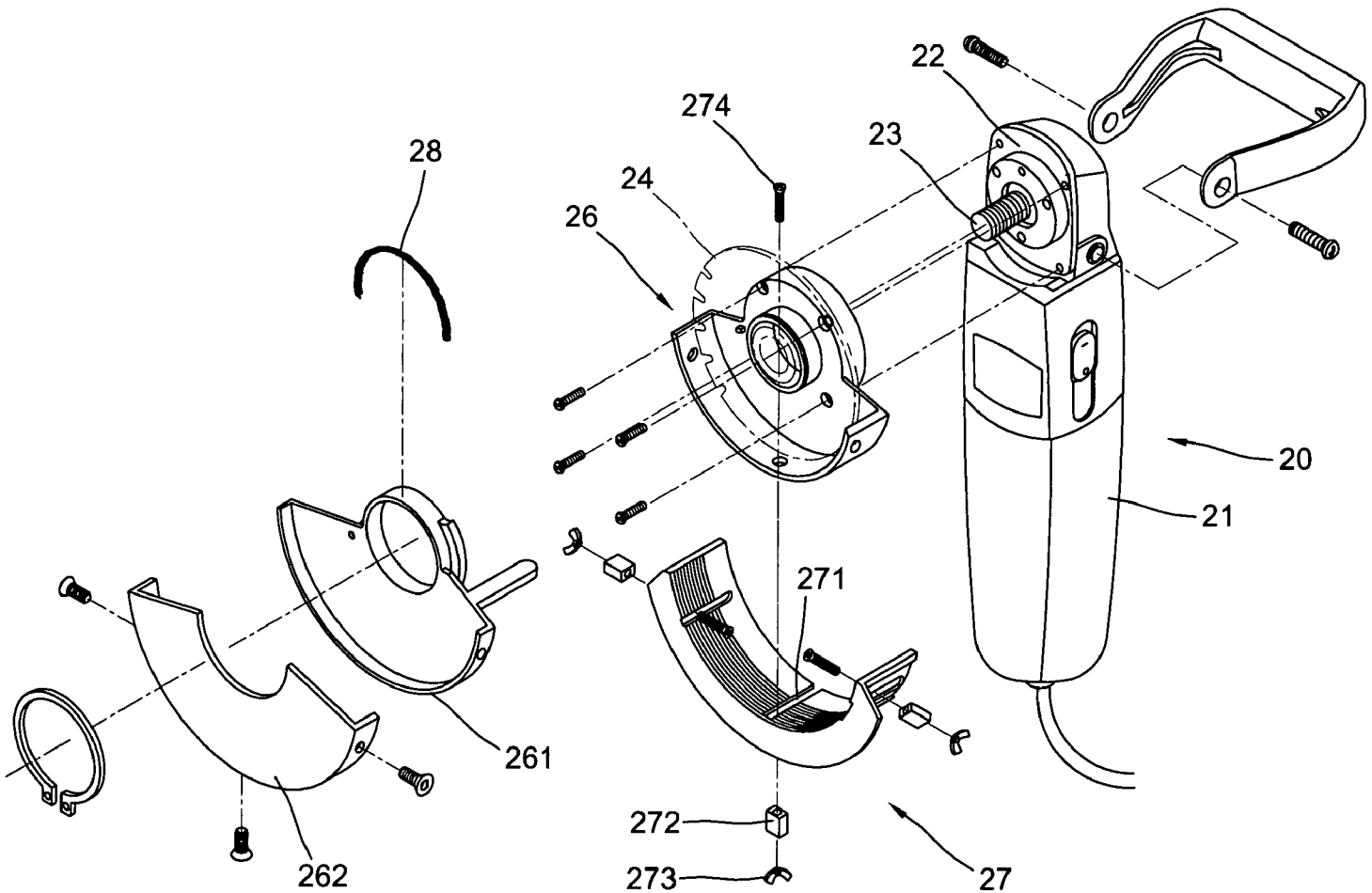
FIG.2 Prior Art
FIGS. 2 and 3 are the exploded perspective view and the sectional view of a hand-operated circular saw according to another prior art.
Figure 3:
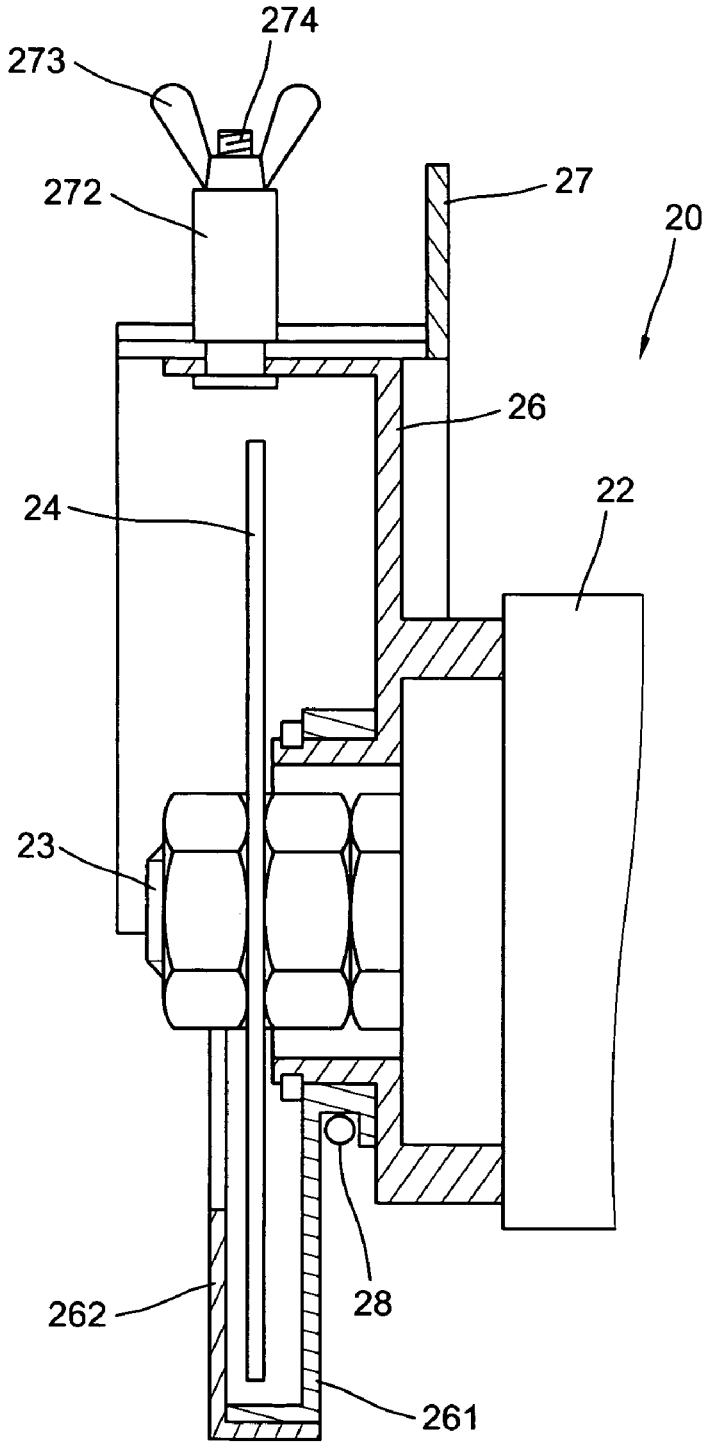
FIG.3 Prior Art
Figure 4:
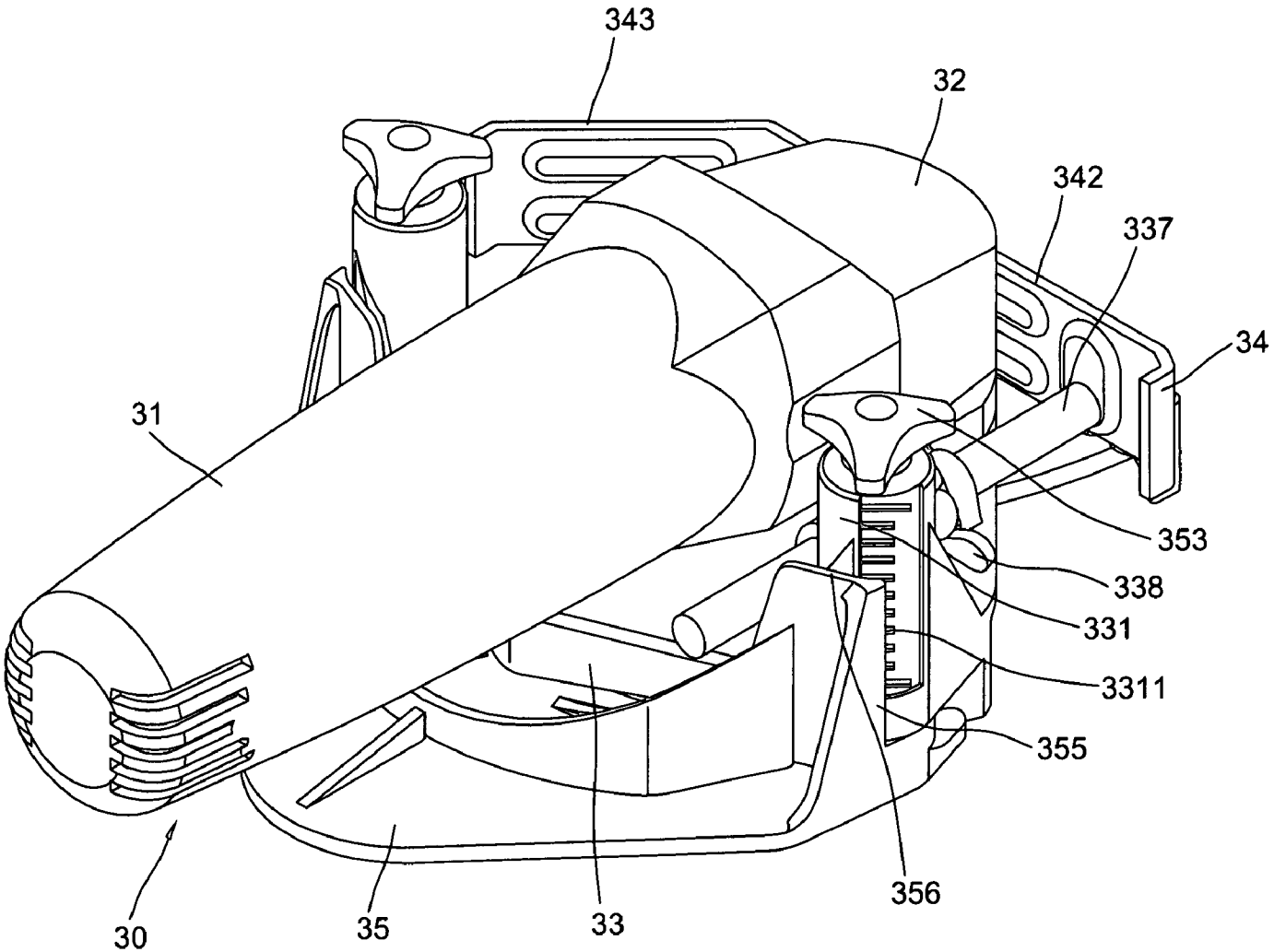
FIG. 4 is a perspective view of a hand-operated circular saw of the preferred embodiment according to the present invention.
Figure 5:
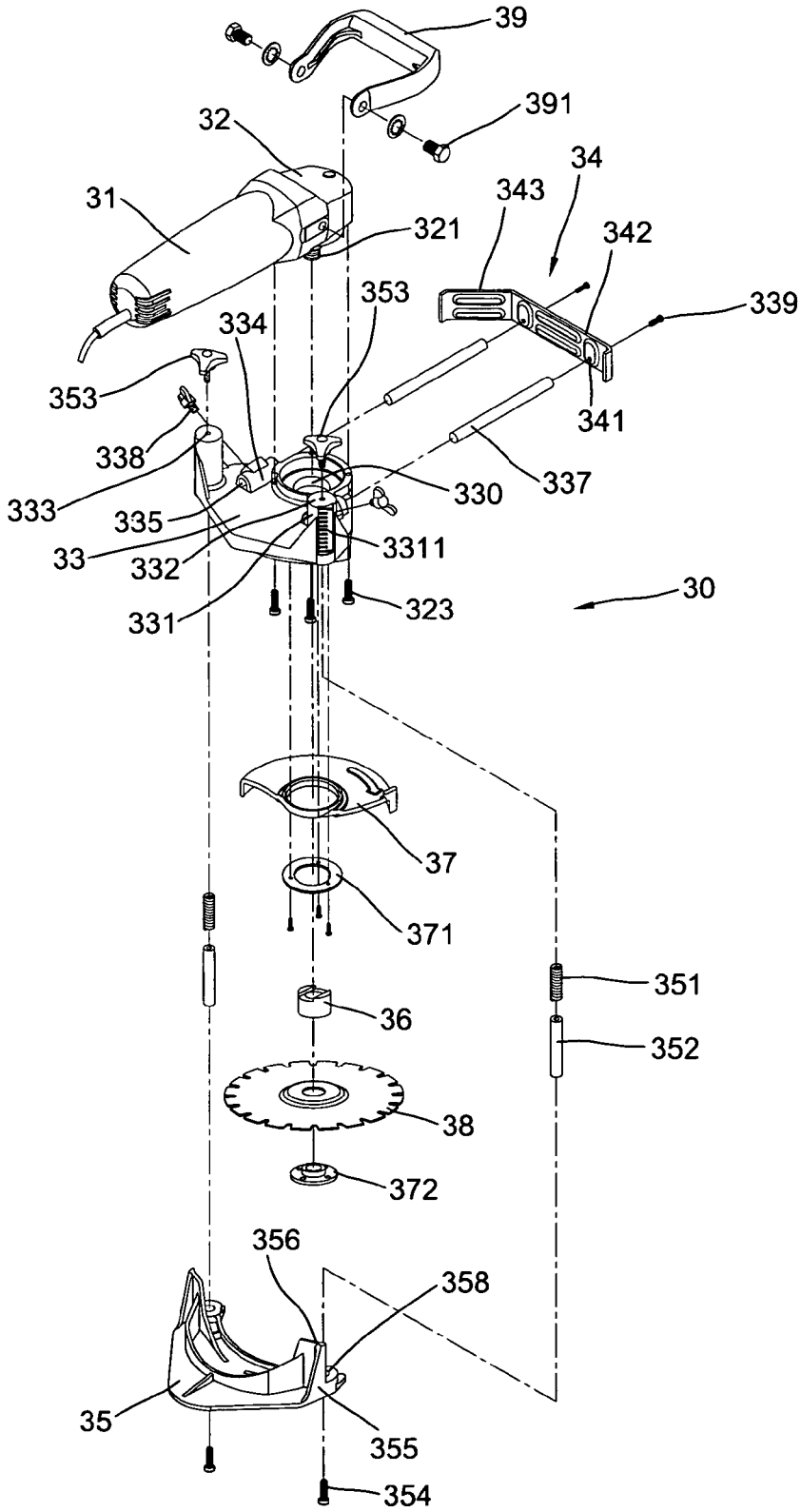
FIG. 5 is an exploded perspective view of FIG. 4.
Figure 6:
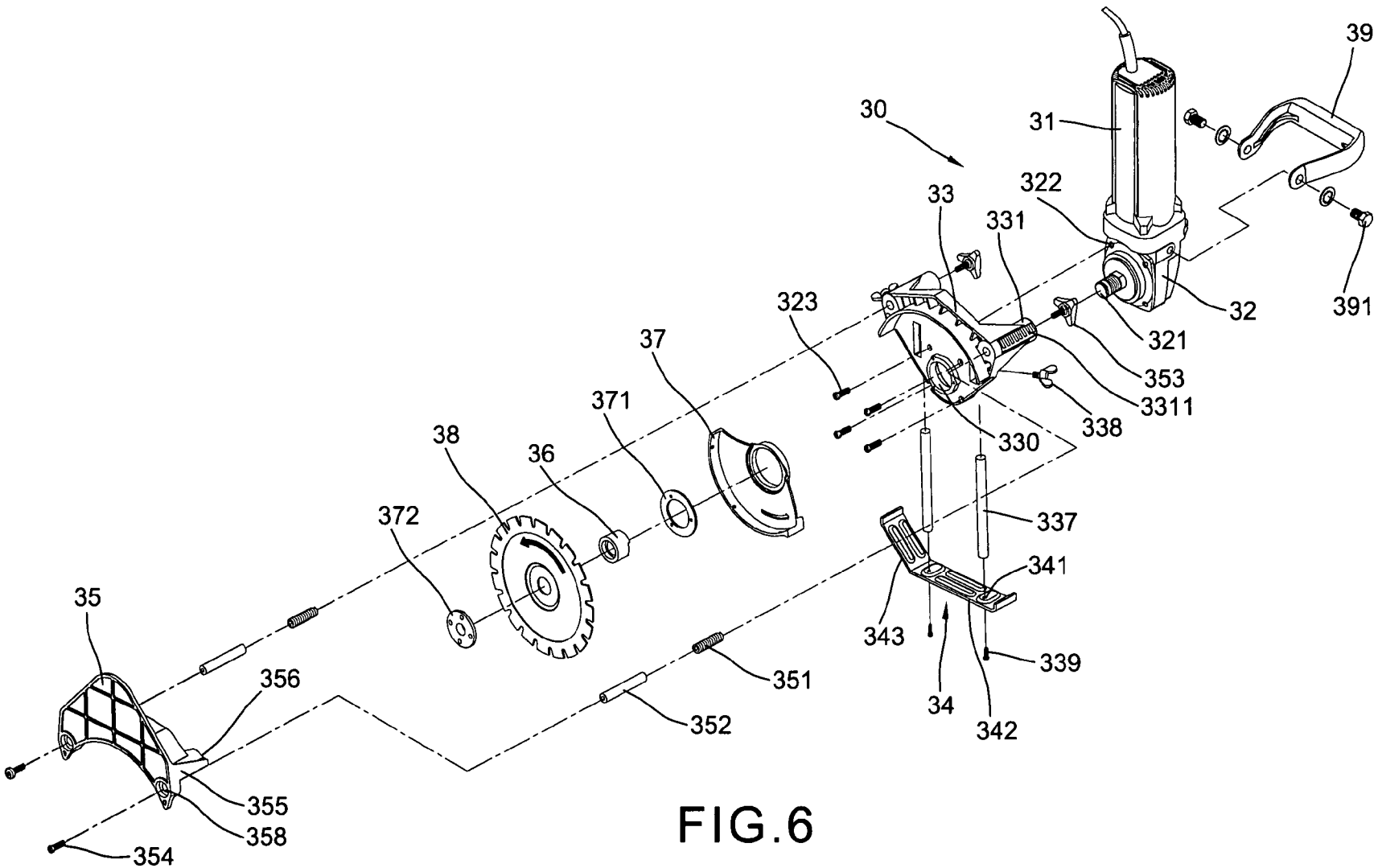
FIG. 6 is an exploded perspective view of FIG. 4, looking from a different angle.
Figure 7:
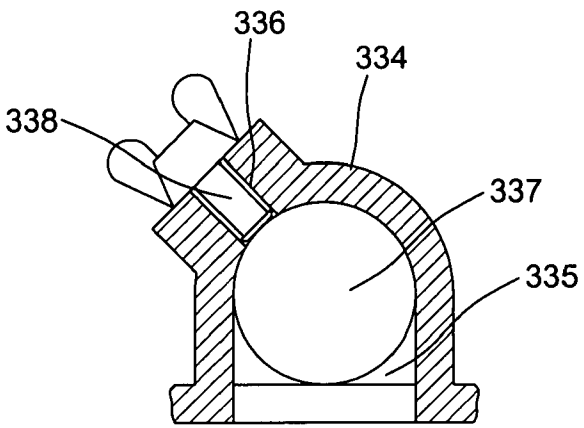
FIG. 7 is a sectional view of a positioning through hole and an elongate rod inside the through hole.

With reference to the drawings and initiated from FIGS. 4, 5 and 6, the hand-operated circular saw having blade cutting depth adjustment device of the present invention comprises a hollow interior tubular body 30 having a hand grasp portion 31, a head portion 32 which includes a threaded axis 321 extruded out from one lateral side operated by, a motor (not shown) embedded therein and a plurality of screw holes 322 spacedly 321 formed in the head portion 32 around a circular protrusion for securing an upper plate 33 by a plurality of screws 323, which has a protrudent circular hole 330 in a plane portion engaged on the circular protrusion 321, a pair of pivotal tubes 331 each has a central bore 332 and 333 spacedly projected upward for respectively receiving a pair of springs 351, a pair of internally threaded cylinder rods 352 for engaging with a pair of quickly operated bolts 353 in the top and connected with a lower plate 35 in the bottom by a pair of screws 354 through a pair of through holes 358 in the lower plate 35, a pair of horizontal arc protrusions 334 spacedly formed on the top of the upper plate 33 each including a central bore 335 for slidably engaging within a pair of internally threaded elongate cylinder rods 337 which are locked by a pair of butterfly bolts 338 through a pair of tilting screw holes 336 (as shown in FIG. 7) and connected at their outer ends with a lateral plate 34 by screws 339 through a pair of through holes 341, wherein the lateral plate 34 has a straight portion 342 and an oblique portion 343 each of the portions 342 and 343 including a pair of parallel slits, the pivotal tubes 331 having graduations 3311 an their outer periphery and the lower plate 35 having a pair of projections 355 spacedly projected upward from upper surface each including a flat top 356 engaged with the graduations 3311 of the pivotal tubes 331, an internally threaded tube 36 engaged with the thread axis 321, a guard plate 37 having an internally threaded central bore engaged with the externally threaded lower portion of the circular hole 330 of the upper plate 33, a circular saw blade 38 secured to the threaded axis 321 with a pad ring 371 engaged therebetween and secured by a disk 372 which has an internally threaded protrudent central bore engaged with the distal portion of the threaded axis 321, and a roughly U-shaped handle 39 pivoted to the head portion 32 by a pair of screws 391 with a pair of washers engaged therebetween. Thereby, the hand-operated circular saw is portable.

Figure 8:
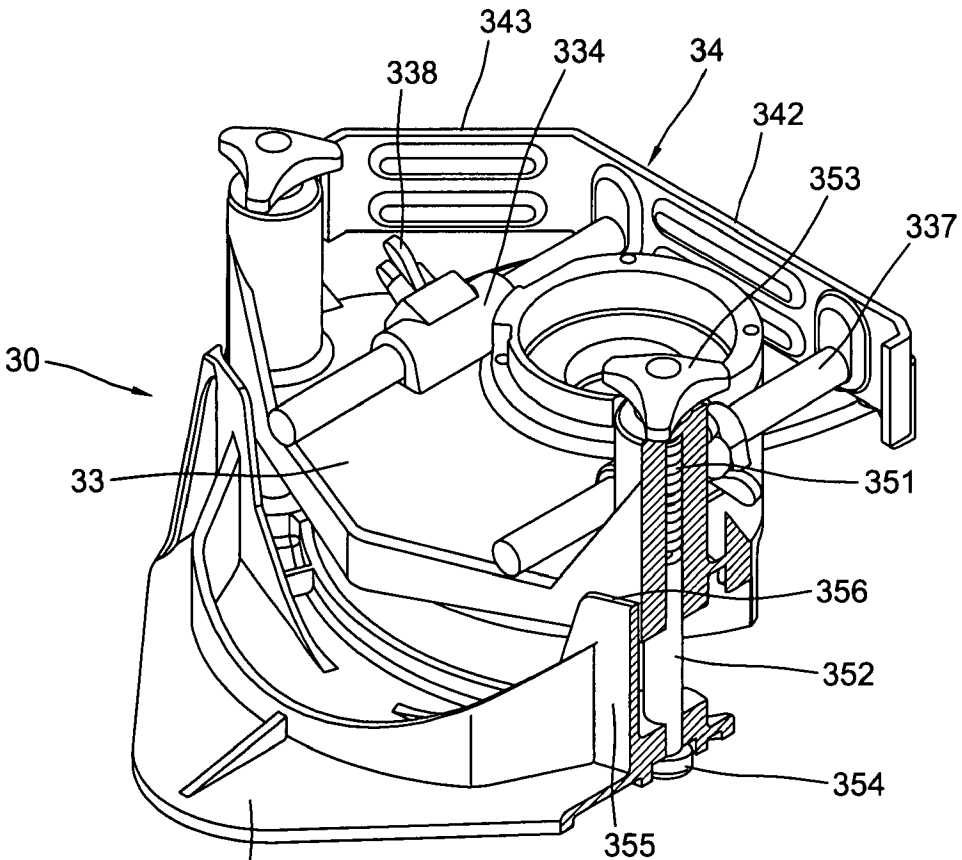
FIG. 8 is a perspective view and partially sectional view to show the details of a pivot tube.
Figure 9:
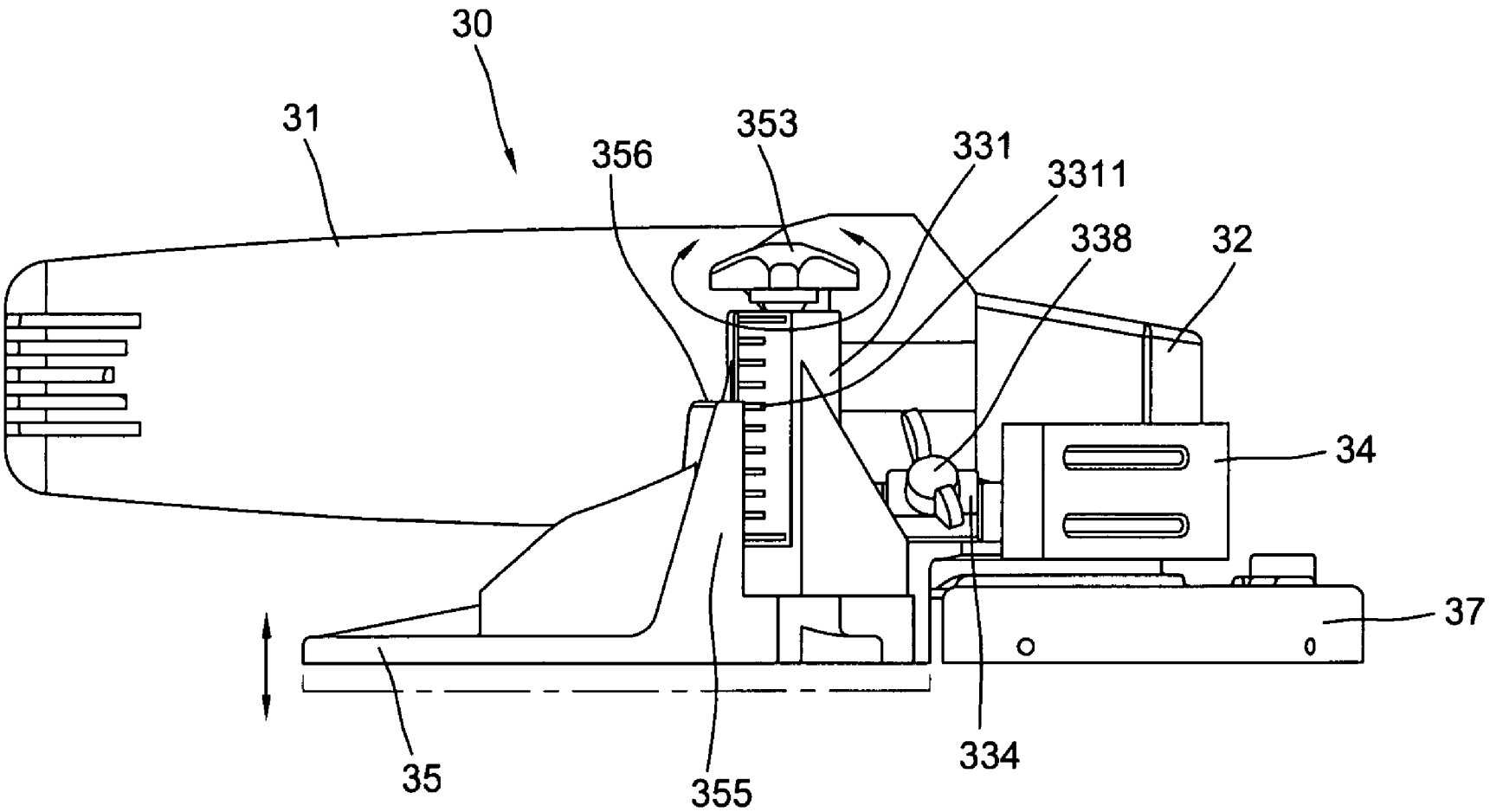
FIG. 9 is a plane view indicating the vertical movement of a lower plate actuated by a quickly operated bolt.

Referring to FIGS. 8 and 9, in operation, put the lower plate 35 on a plane surface of a work table or a wall and turn about the quickly operated bolts 353 to adjust the vertical position of the lower plate 35 referring to the graduations 3311 on the pivotal tubes 331 and the vertical position of the saw blade 38 is simultaneously adjusted so that the user needs not to try again and again. The springs 351 in the pivotal tubes 331 provide the proper counteraction force to enable the quickly operated bolts 353 a stable engagement in the pivotal tubes 331 without loosening.

Figure 10:
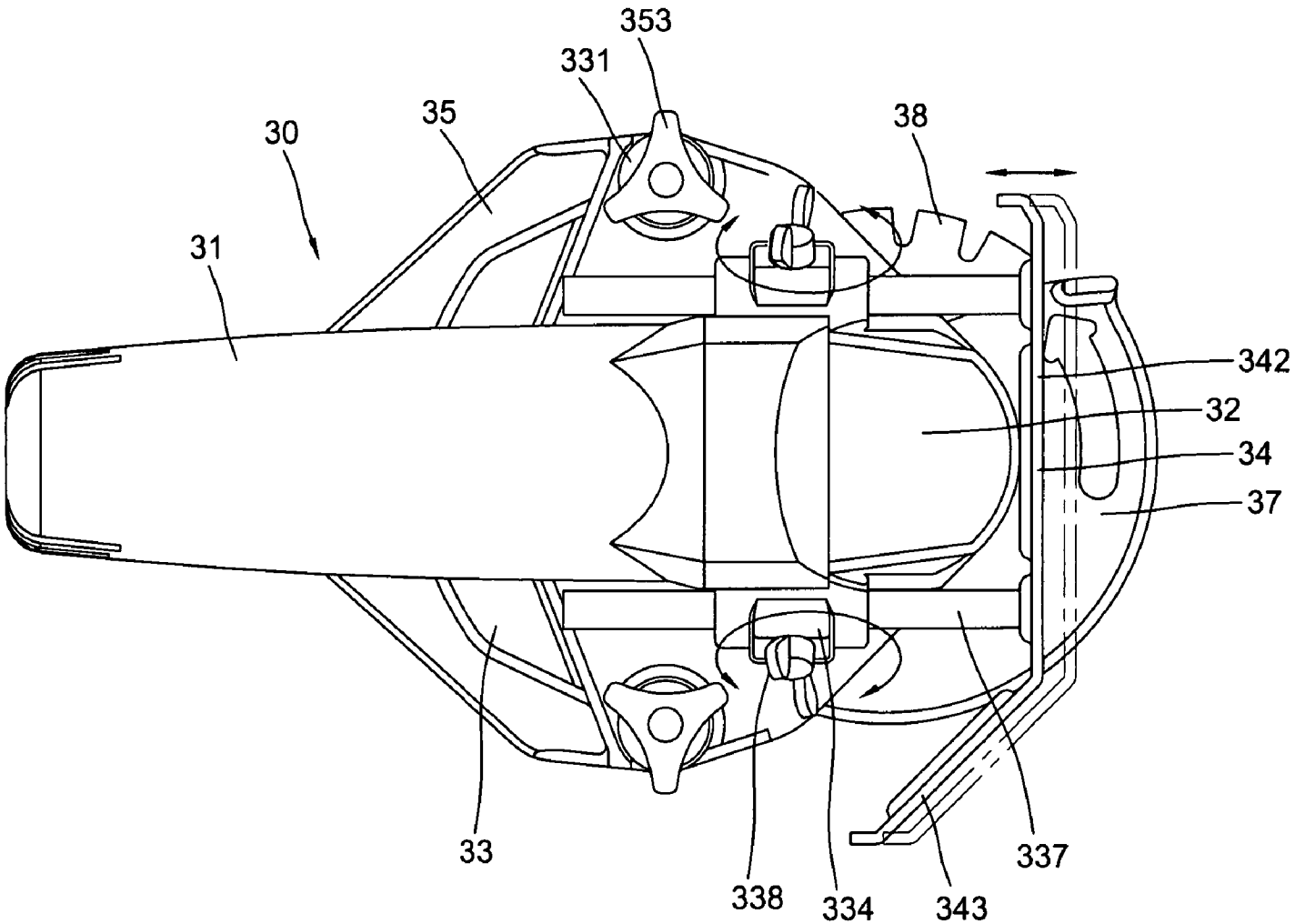
FIG. 10 is a plane view indicating the horizontal movement of a lateral plate.
Figure 11:
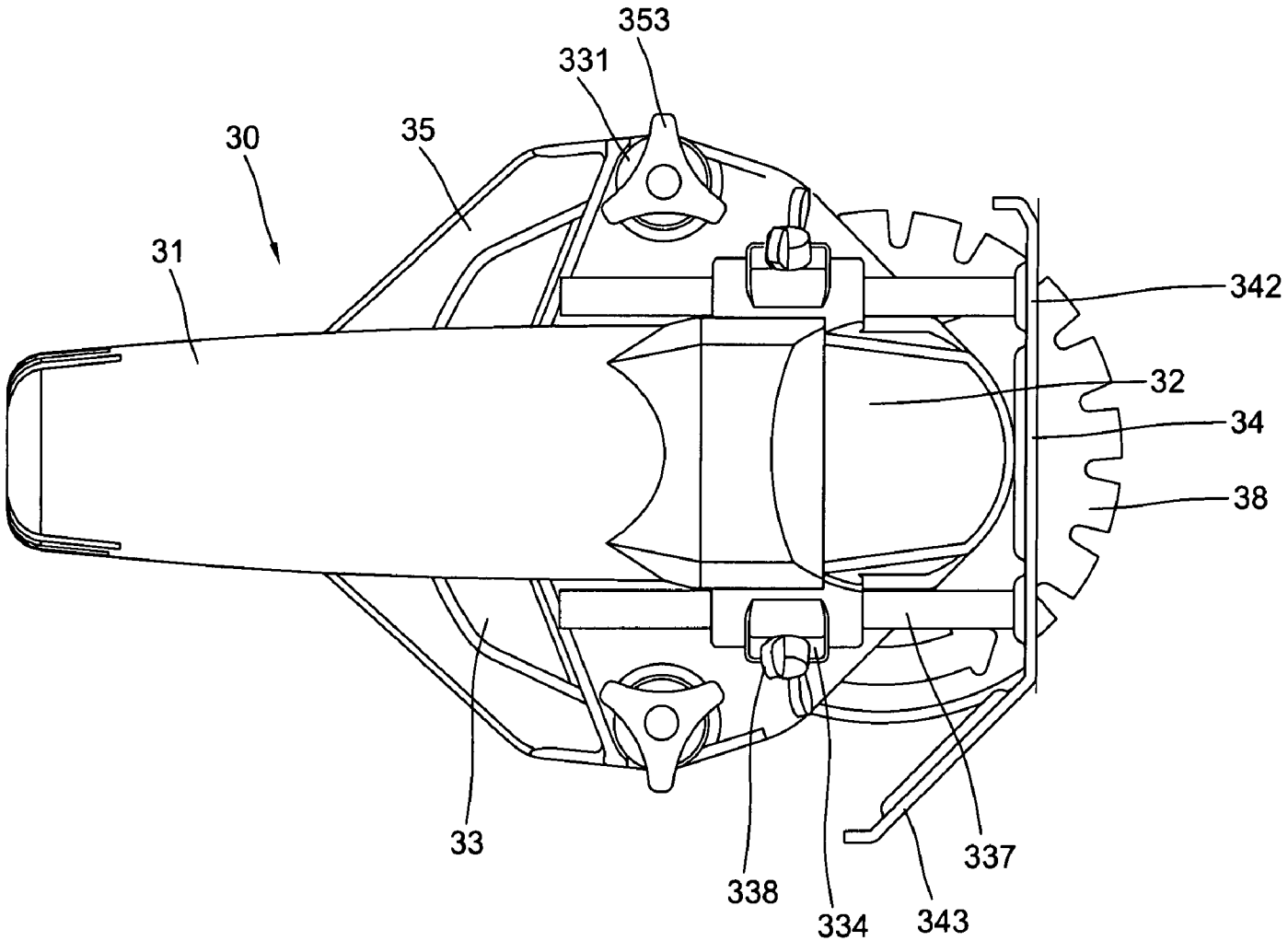
FIG. 11 is a plane view indicating that the lateral plate is already at a desired position.

Referring to FIGS. 10 and 11, when loosens the butterfly bolts 338 to allow the internally threaded elongate cylinder rods 337 free to slide within the central bore 335 of the horizontal arc protrusions 334, the lateral plate 34 is horizontally adjustable to find a desired position relative to the saw blade 38 which is a protruded through hole 341 of the lateral plate 34. Then fastens the butterfly bolts 338 again. When cutting a work piece, the straight portion 342 of the lateral plate 34 may contact the upper surface of the work piece or the oblique portion 343 leans on a table or a wall to form a slant angle between the tubular body 30 and the wall to conduct a proper cutting manner. The guard plate 37 which is movably pivoted to the upper plate 33 can be turned to an angle to prevent the dirt and the water from sprayed to the user. Farther, if the lower plate 35 may lean on the wall where the lateral plate 34 contacts the ground, the cutting action can be also performed. Actually, both the lower plate 35 and the lateral plate 34 are functioned as the rulers to be complied with during the cutting period and the cutting results must be accurate.

Figure 12:
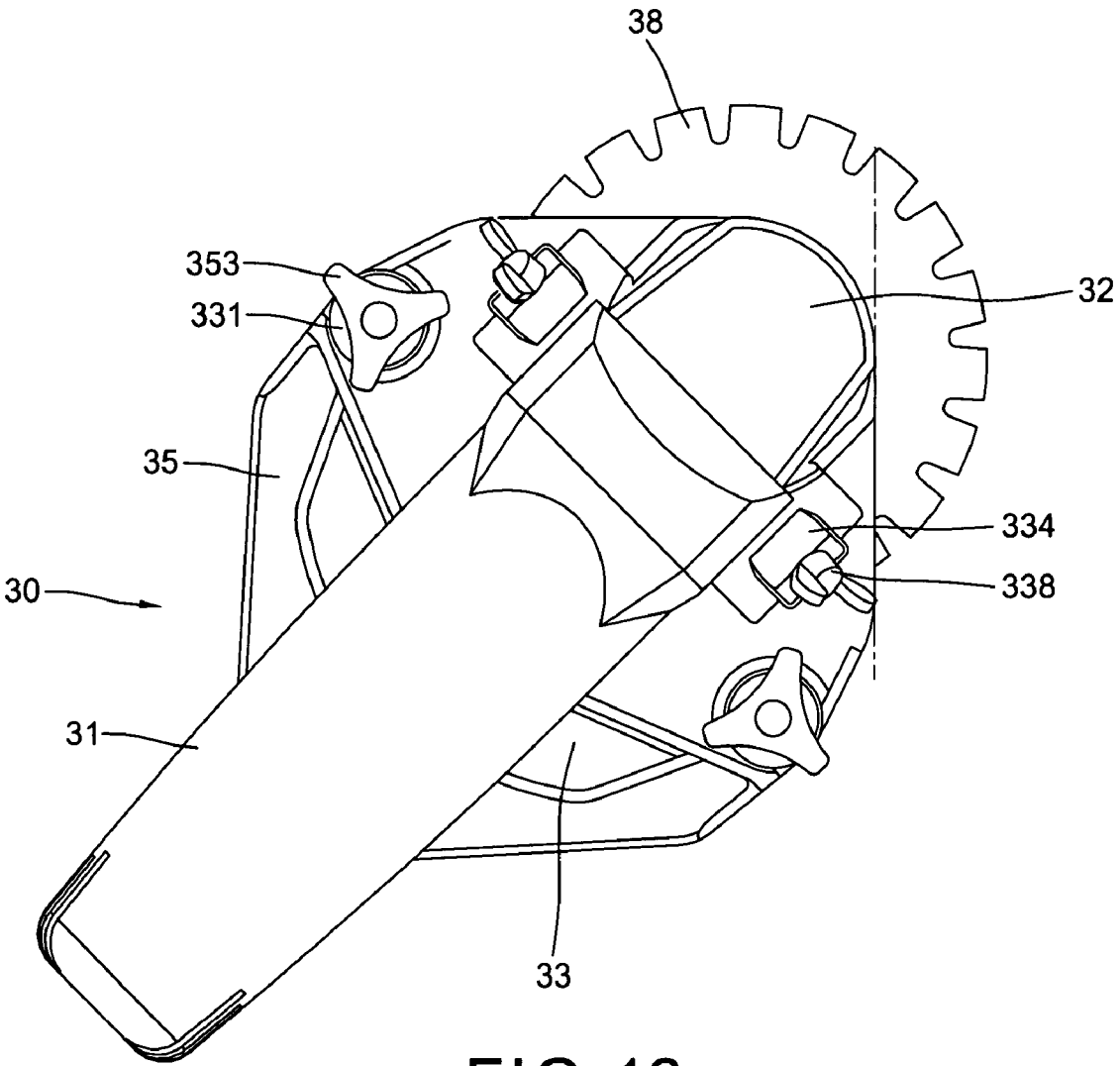
FIG. 12 is a plane view indicating that an oblique portion of the lateral plate leans on a plane surface of a wall.

FIG. 12 shows that the hand-operated circular saw of the present invention may be operated without the lateral plate 34.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. A hand-operated circular saw having a blade cutting depth adjustment device comprising:

a hollow interior tubular body having a hand grasp portion and a head portion from which is a motor operating a threaded axis protruded, a peripherally threaded circular protrusion on a lateral side thereof, a plurality of first screw holes spacedly formed in said lateral side around said circular protrusion and a pair of second screw holes respectively formed in opposing sides of the head portion;

an upper plate disposed to said head portion having a plurality of through holes respectively engaged with said first screw holes and secured by a plurality of screws, a protrudent circular hole in a plane portion engaged on the peripherally threaded circular protrusion, a pair of pivotal tubes spacedly projected upward from an upper surface of the upper plate for respectively receiving a pair of springs and a pair of internally threaded cylinder rods therein, a pair of quickly operated bolts engaged with upper end of said cylinder rods respectively, wherein said pivotal tubes each having graduations on their outer periphery and a pair horizontal arc protrusions spacedly formed on the upper surface positioned on opposing sides of said protrudent circular hole each having a central bore and a tilting screw hole engageable with a pair butterfly bolts;

an internally threaded tube engaged with said threaded axis of said head portion;

a guard plate engaged with said circular protrusion of said head portion;

a circular saw blade secured to said threaded axis by a disk with a pad ring engaged therebetween;

a lower plate having a pair of through holes spacedly formed at two ends engaged with lower end of said internally threaded cylinder rods respectively secured and by a pair of screws, a pair of projections spacedly projecting upward from an upper surface of the lower plate and each having a flat top engageable with the graduations of said pivotal tubes respectively;

a lateral plate having a straight portion and an oblique portion and each of said portions having a pair of parallel slits engageable with said saw blade, wherein said straight portion further having a pair of through holes spacedly formed in two ends of said parallel slits and connected with outer end of a pair of internally threaded elongate cylinder rods respectively secured by a pair of screws, said elongate cylinder rods each having an inner end slidably inserted into said horizontal arc protrusions of said upper plate respectively fastened by said butterfly bolts;

a U-shaped handle pivoted to said second screw holes of said head portion by a pair of screws respectively;

whereby said hand-operated circular saw is portable.

2. The hand-operated circular saw as recited in claim 1, wherein said lower plate and said lateral plate could lean on a plane surface of a table, a wall and a ground.

3. The hand-operated circular saw as recited in claim 1, wherein said circular saw can operate without said lateral plate.

* * * * *